US008276748B2

(12) United States Patent
Nyambi et al.

(10) Patent No.: US 8,276,748 B2
(45) Date of Patent: Oct. 2, 2012

(54) INGREDIENT RELEASE SPOUT

(75) Inventors: Samuel Ombaku Nyambi, Marietta, GA (US); Fritz Seelhofer, Lindau (CH)

(73) Assignee: The Coca-Cola Company, Atlanta, GA (US)

( * ) Notice: Subject to any disclaimer, the term of this patent is extended or adjusted under 35 U.S.C. 154(b) by 320 days.

(21) Appl. No.: 11/686,985

(22) Filed: Mar. 16, 2007

(65) Prior Publication Data

US 2008/0223485 A1 Sep. 18, 2008

(51) Int. Cl.
*B65D 25/08* (2006.01)
*B65D 51/18* (2006.01)
*B65D 39/00* (2006.01)

(52) U.S. Cl. ..... 206/222; 206/219; 220/254.9; 215/257

(58) Field of Classification Search ..... 206/22, 206/568, 219–222; 215/217, 223, 228, 257, 215/296, 297, 390, 391, DIG. 8; 220/212, 220/254.1, 254.9, 260, 277, 284, 345.1, 502
See application file for complete search history.

(56) References Cited

U.S. PATENT DOCUMENTS

| | | | | |
|---|---|---|---|---|
| 2,004,018 | A | 6/1935 | Strauss | |
| 2,275,567 | A | 3/1942 | Smith | |
| 3,326,400 | A * | 6/1967 | Hamelin et al. | 206/221 |
| 4,167,228 | A | 9/1979 | Cheetham | |
| 4,195,730 | A | 4/1980 | Hunt | |
| 4,294,351 | A | 10/1981 | Cheetham | |
| 4,682,689 | A * | 7/1987 | Pereira et al. | 206/222 |
| 5,020,690 | A * | 6/1991 | Kishikawa et al. | 222/83 |
| 5,246,142 | A | 9/1993 | DiPalma et al. | |
| 5,292,019 | A * | 3/1994 | Patterson | 215/256 |
| 5,370,222 | A | 12/1994 | Steigerwald et al. | |
| 5,396,986 | A | 3/1995 | Fountain et al. | |
| 5,461,867 | A | 10/1995 | Scudder et al. | |
| 6,098,795 | A | 8/2000 | Mollstam et al. | |
| 6,138,821 | A | 10/2000 | Hsu | |
| 6,148,996 | A | 11/2000 | Morini | |
| 6,152,296 | A | 11/2000 | Shih | |
| 6,305,575 | B1 | 10/2001 | Wrigley | |
| 6,382,462 | B1 * | 5/2002 | Ostergaard-Nielsen et al. | 222/1 |
| 6,387,073 | B1 | 5/2002 | Weiler et al. | |
| 6,422,412 | B1 * | 7/2002 | Sagawa | 220/277 |
| 6,527,110 | B2 | 3/2003 | Moscovitz | |

(Continued)

FOREIGN PATENT DOCUMENTS

EP 1222122 B1 6/2003

(Continued)

OTHER PUBLICATIONS

International Search Report of PCT/US2008/056128.

*Primary Examiner* — J. Gregory Pickett
*Assistant Examiner* — Kaushikkumar Desai
(74) *Attorney, Agent, or Firm* — Sutherland Ashbill & Brennan LLP

(57) ABSTRACT

A spout for an associated container for dispensing a substance into the container. The spout may include a cap, a capsule that can be filled and sealed with a sealing layer, and a nozzle that can be screwed onto the container and carries a piercing device protruding therein such that the sealing layer of the capsule is pierced by the piercing device upon the turning of the cap.

13 Claims, 17 Drawing Sheets

U.S. PATENT DOCUMENTS

| | | | | |
|---|---|---|---|---|
| 6,533,113 | B2 | 3/2003 | Moscovitz | |
| 6,571,994 | B1 | 6/2003 | Adams et al. | |
| 6,644,471 | B1 | 11/2003 | Anderson | |
| 6,645,419 | B2 | 11/2003 | Wrigley | |
| 6,763,939 | B2 | 7/2004 | Alticosalian | |
| 6,840,373 | B2 | 1/2005 | Gibler et al. | |
| 6,854,595 | B2 | 2/2005 | Kiser | |
| 6,935,493 | B2 | 8/2005 | Cho | |
| 6,945,393 | B2 | 9/2005 | Cho | |
| 7,017,735 | B2 | 3/2006 | Carlson | |
| 7,172,095 | B2 | 2/2007 | Marshall | |
| 7,175,049 | B2 | 2/2007 | Kastenschmidt et al. | |
| 2002/0053524 | A1 | 5/2002 | Alticosalian | |
| 2002/0157970 | A1 | 10/2002 | Carlson | |
| 2002/0179461 | A1 | 12/2002 | Mallstam et al. | |
| 2003/0132244 | A1 | 7/2003 | Birkmayer et al. | |
| 2003/0213709 | A1 | 11/2003 | Gibler et al. | |
| 2004/0200742 | A1 | 10/2004 | Cho | |
| 2005/0167295 | A1 | 8/2005 | Shenkar et al. | |
| 2005/0211579 | A1 * | 9/2005 | Makita | 206/219 |
| 2006/0108314 | A1 | 5/2006 | Cho | |
| 2007/0023299 | A1 | 2/2007 | Clarkson | |
| 2007/0045134 | A1 | 3/2007 | Dvorak et al. | |
| 2007/0280042 | A1 * | 12/2007 | Yamanaka | 366/185 |
| 2009/0242561 | A1 | 10/2009 | Wellman | |
| 2009/0261000 | A1 | 10/2009 | Epp et al. | |
| 2009/0308831 | A1 | 12/2009 | Anderson | |
| 2010/0163442 | A1 | 7/2010 | Lee et al. | |
| 2010/0237075 | A1 | 9/2010 | Wilhelm | |

FOREIGN PATENT DOCUMENTS

| | | | |
|---|---|---|---|
| EP | 1278680 | | 3/2007 |
| EP | 1682443 | B1 | 5/2010 |
| EP | 2181932 | A1 | 5/2010 |
| EP | 2216262 | A1 | 8/2010 |
| EP | 2114791 | B1 | 9/2010 |
| FR | 2453793 | | 4/1979 |
| FR | 2569666 | | 8/1984 |
| FR | 2616322 | A1 | 6/1987 |
| GB | 1479370 | | 8/1974 |
| GB | 2405868 | | 3/2005 |
| GB | 2466187 | | 6/2010 |
| WO | 0146035 | A1 | 6/2001 |
| WO | 01/83313 | A2 | 11/2001 |
| WO | 2004089777 | A2 | 10/2004 |
| WO | 2005023667 | A1 | 3/2005 |
| WO | 2006037244 | A1 | 4/2005 |
| WO | 2006/035558 | A1 | 4/2006 |
| WO | 2006046725 | A1 | 5/2006 |

* cited by examiner

FIG. 20
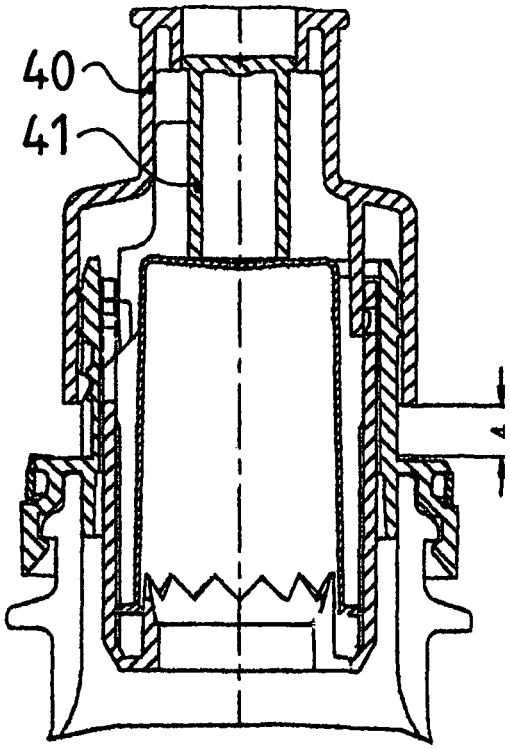
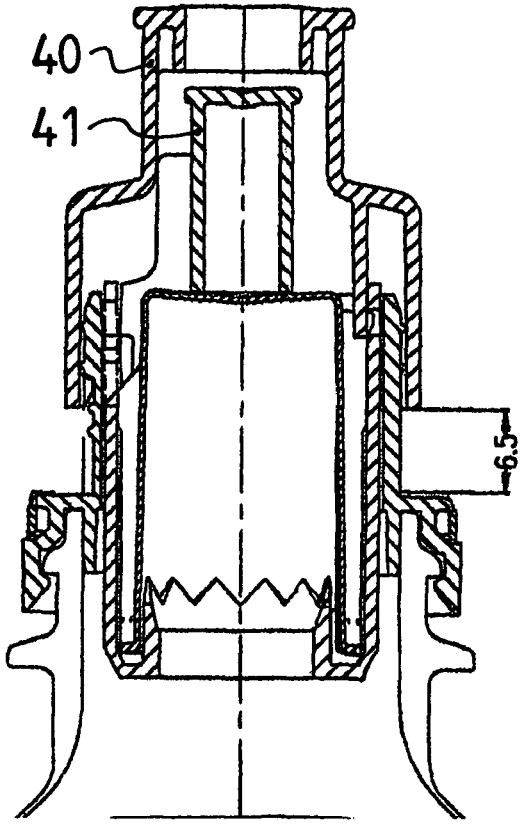
FIG. 21
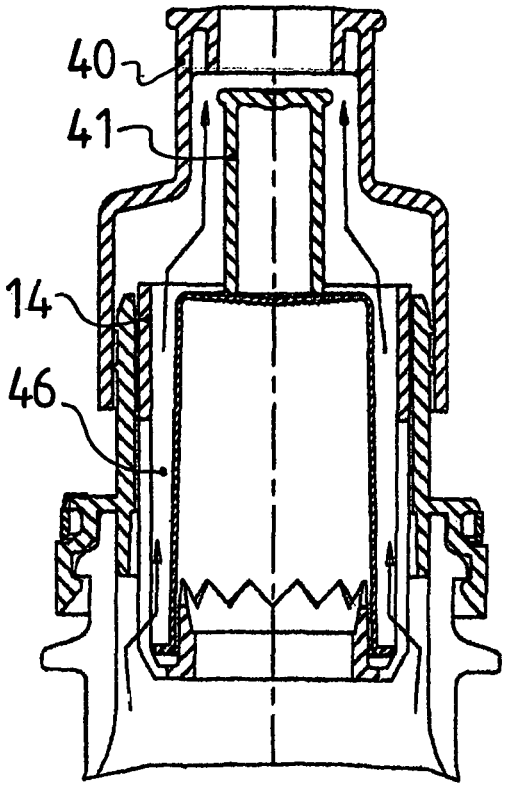
FIG. 22

INGREDIENT RELEASE SPOUT

TECHNICAL FIELD

The present application relates to a spout and an associated integrated capsule for setting this spout on the nozzles of different containers. This spout permits dispensing a separate substance in liquid or free-flowing form from this capsule into the container. This dispensing takes place automatically when the spout is opened for the first time so as to also provide a tamperproof seal.

BACKGROUND OF THE INVENTION

Numerous bottled drinks are manufactured today by mixing concentrates in large quantities of water. The drinks are then bottled and distributed. Instead of offering the drink in a final mixed form, it would be more efficient if the bottler could just fill a liquid, especially water, with the concentrate and mixed with the liquid only when the consumer opens the bottle for the first time. For this purpose, the concentrate is added automatically into the liquid or in the water such that both are mixed when the consumer opens the bottle for the first time.

There is a desire, therefore, to produce a plastic spout with an associated nozzle that provides for automatic dispensing of a separate substance into the container when the consumer opens the plastic spout for the first time.

SUMMARY OF THE INVENTION

The present application thus provides a spout for an associated container for dispensing a substance into the container. The spout may include a cap, a capsule that can be filled and sealed with a sealing layer, and a nozzle that can be screwed onto the container and carries a piercing device protruding therein such that the sealing layer of the capsule is pierced by the piercing device upon the turning of the cap.

The spout may be a plastic spout. The capsule may be aligned downwards within the cap or within the nozzle. The nozzle may include an opening sleeve that stretches inside the container. The opening sleeve may include the piercing device. The piercing device may include a piercing and cutting tooth or a cutting tooth.

The cap and the capsule may include a number of cooperating force transmission components. The force transmission components may include a helical collar positioned about the capsule and a helical margin positioned about the cap. The capsule may include a number of straight sections and the opening sleeve may include a number of plane sides such that the capsule can be inserted in the opening sleeve only from the top.

The cap may include a groove and the nozzle may include a collar on which a number of snap-on cams or continuous snap-on beads are formed such that the cap cannot be displaced in an axial direction vis-à-vis the nozzle. The nozzle may include a number of barbs and the cap may include a handle such that the barbs and the handle cooperate as a ratchet such that the cap can only be rotated in one direction. The cap may include a bulge thereon from which a shear pin protrudes such that the nozzle may include an opening to cooperate therewith.

The nozzle may include a counter-clockwise rotating thread and the cap is screwed on in a counter-clockwise direction until a guarantee tape is reached. After the guarantee tape is removed, the cap can be screwed completely on to the nozzle while piercing the sealing layer of the capsule. The cap may include a guarantee tape with a longitudinal window therein.

The cap may include a drink nozzle that is turned up through a coaxial stopper such that the capsule is pierced by the piercing device when the stopper is pressed downwards. The stopper completely seals the opening of the drink spout in an initial pull-out position and in a second, completely pulled-out position of the cap, the opening of the drink spout lies above the stopper. The cap may be sealed by a mountable protective cap. The piercing device forms a crown of piercing and cutting teeth. The spout further may include a clearance about the stopper for a liquid to flow therethrough.

The present application further describes a plastic spout for a container nozzle of a container for automatically dispensing a separate substance into the container through an opening of the plastic spout. The spout may include a cap, a capsule that can be filled separately and sealed with a foil or else sealed after filling, and a screw-on nozzle that can be screwed onto the container nozzle. The capsule with its sealing foil can be fixed within the cap or in the screw-on nozzle. The screw-on nozzle carries an opening sleeve that stretches inside the container nozzle when the screw-on nozzle is set and includes a piercing and cutting device with a piercing and cutting tooth or a cutting tooth. The nozzle further includes a number of force transmission components such that the capsule can be displaced upon the loosening of the cap and the opening sleeve with piercing and cutting of its scaling foil via the piercing and cutting teeth or the cutting tooth.

These and other features of the present application will become apparent to one of ordinary skill in the art upon review of the following detailed description when taken in conjunction with the drawings and the appended claims.

BRIEF DESCRIPTION OF THE DRAWINGS

In the figures, the different variants of this spout are shown in different views. With the help of these figures, the spout is described in detail and its function is explained.

FIG. 20 is a cross-sectional view of the plastic spout as per FIG. 13 with the drink nozzle in this close position having an extended design.

FIG. 21 is a cross-sectional view of the plastic spout as per FIG. 20 with the drinking nozzle in the open position.

FIG. 22 is a cross-sectional view of the plastic spout as per FIG. 20 with the drinking nozzle in the open position, but rotated by a few angular degrees, so that the path of the liquid flowing out is visible.

DETAILED DESCRIPTION

A common feature of all of the variants of the spout presented here is that they contain a capsule with a separate substance. The substance may be a liquid, a solid such as a powder, or any substantially flowable substance. The capsule is opened when the spout is opened for the first time such that the substance falls down in the container lying below it. Another common feature is that this capsule is always arranged in an overturned position inside the spout. This means that the fixed base of the capsule lies on the top and its open side, sealed with a sealing foil, lies on the bottom. The capsule is present inside the container nozzle or at least protrudes inside it to a large part. The lower edge of the spout generally lies below the upper margin of the container nozzle or the container neck.

To open the capsule, this foil is automatically pierced or cut with a special opening device such that the contents of the capsule fall down in the container. Depending upon the design of the spout, this opening device may be inside the cap or the screw-on nozzle and is pushed downwards in a translatory way and is pressed over the sealing foil. Alternatively, the capsule is pushed downwards by means of a rotating movement along a helix such that its sealing foil is then cut after being pierced by the stationary opening device upon a further rotary movement along the helix.

Figure 1:
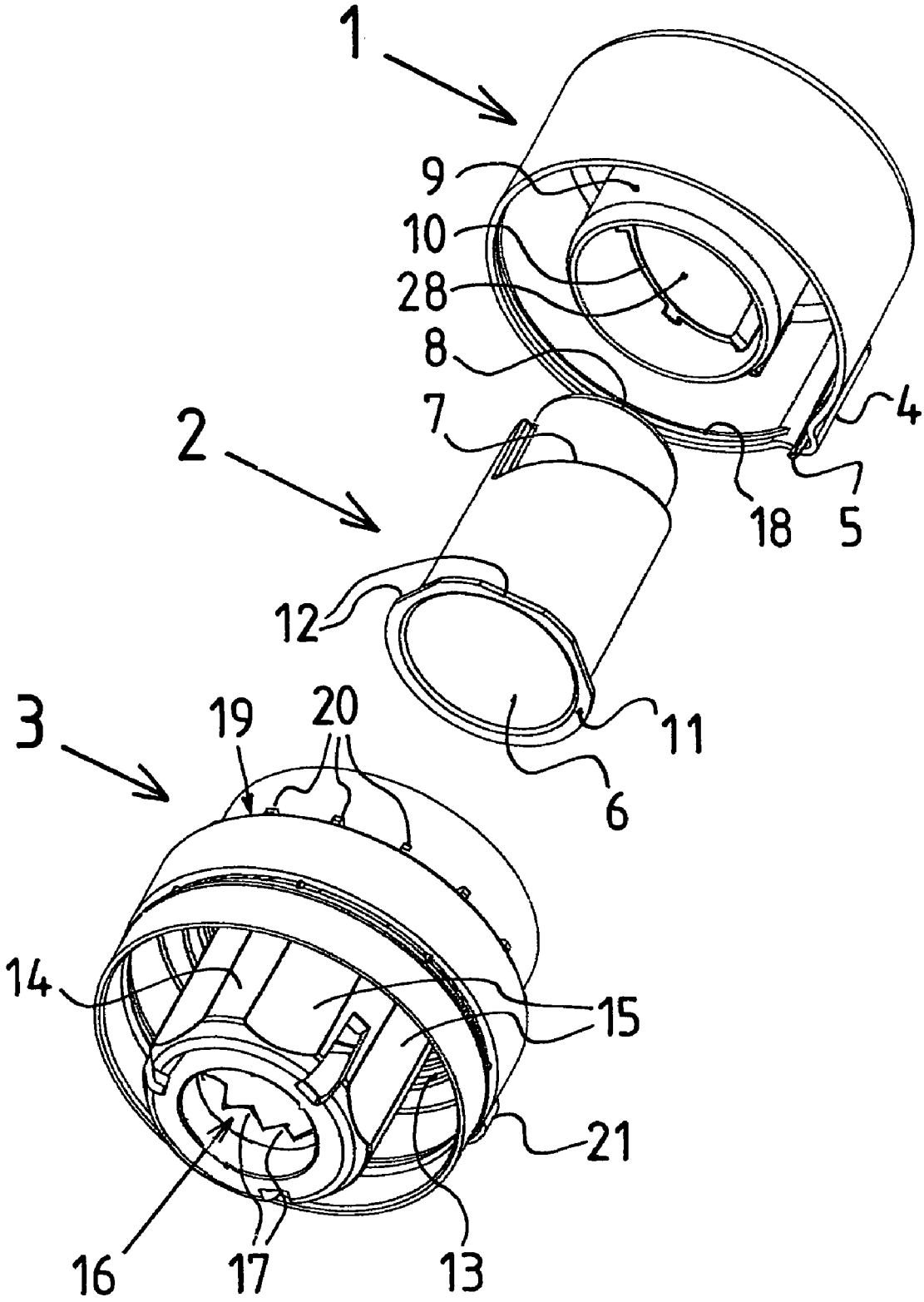
FIG. 1 is an exploded view of the individual parts of the first variant of the plastic spout with a rotating cap, a capsule, and a screw-on nozzle with opening sleeve shown separately, viewed diagonally from below.

FIG. 1 shows the individual parts of the first variant of this plastic spout with a rotating cap 1, a capsule 2, and a screw-on nozzle 3 with an opening sleeve 14. One can see here the parts diagonally from below. The parts may be made from plastics, metallics, or any other convenient material. On the top or on the right, one sees the rotating cap 1 of the spout. On one side of its peripheral wall has a bulge 4. There is a shear pin 5 in this bulge 4 that protrudes a little above the bulge 4 and which acts as the tamperproof guarantee. Below this one can see the cylindrical capsule 2. The capsule 2 is open on the bottom and is sealed with a sealed foil 6 after it is filled. In the peripheral wall is a helical collar 7 that acts as a sliding curve, as will be explained later. The capsule 2 can be inserted with its base 8 forward into a guide sleeve 9 inside the cap 1 and fixed in a concentric position to the cap 1. The upper part of the capsule 2 then lies in the inside of this guide sleeve 9 on the cap base, within which a guide sleeve 28 with a helical margin 10 is formed. By setting the capsule 2 in this guide sleeve 28, the helical collar 7 closes so as to form the sliding curve at the capsule 2 in a form-fitting way to the helical margin 10 of this guide sleeve 28 inside the guide sleeve 9. At the lower end of the capsule 2, this runs out in a laterally projecting edge 11 that has several straight sections 12 on the outside around its periphery. Below the capsule 2, the screw-on nozzle 3 can be seen. On its lower inner side is an inner thread 13, with which it can be screwed on the outer thread of a container nozzle. The container may be a bottle made of glass or plastic. Likewise, the container may be a plastic container, a carton, a steel canister with plastic nozzles, and the like.

Inside the screw-on nozzle 3, an opening sleeve 14 runs concentrically and is connected with the upper margin of the screw-on nozzle 3 on the top with a material bridge. This opening sleeve 14 shows, in the given example, several plane side bands 15. The capsule 2 thus can be inserted in the opening sleeve 14 from the top in such a way that it is straight or the plane sections 12 on its lower projecting edge 11 lie opposite these plane side bands 15 of the opening sleeve 14. In this way, the capsule 2 is protected against a slipping inside the opening sleeve 14 and can move in only a translatory way along the axis of rotation of the screw-on nozzle 3. At the lower end of the opening sleeve 14, it shows a piercing and cutting device 16 with piercing and cutting teeth 17 projecting upward on the inner side of the opening sleeve 14. During the course of mounting, the cap 1 is forced on to the screw-on nozzle from the top under inclusion of the filled capsule 6 and sealed on the lower side with the sealing foil 6. Inside the cap 1, a groove 18 runs along its lower edge. The screw-on nozzle, on the other hand, forms a collar 19 on which radial outstanding cams 20 are formed. The cap 1 thus can be pressed on these cams 20 with its inner lying groove 18, which then snap in the groove 18. Thereafter, the cap 1 is held firmly on the screw-on nozzle 3, but can be rotated thereon. The rotating position of the cap 1 is thereby selected in such a way that its shear pin 5 engages in a corresponding accommodation hole 21 on the outer side of the screw-on nozzle 3.

Figure 2:
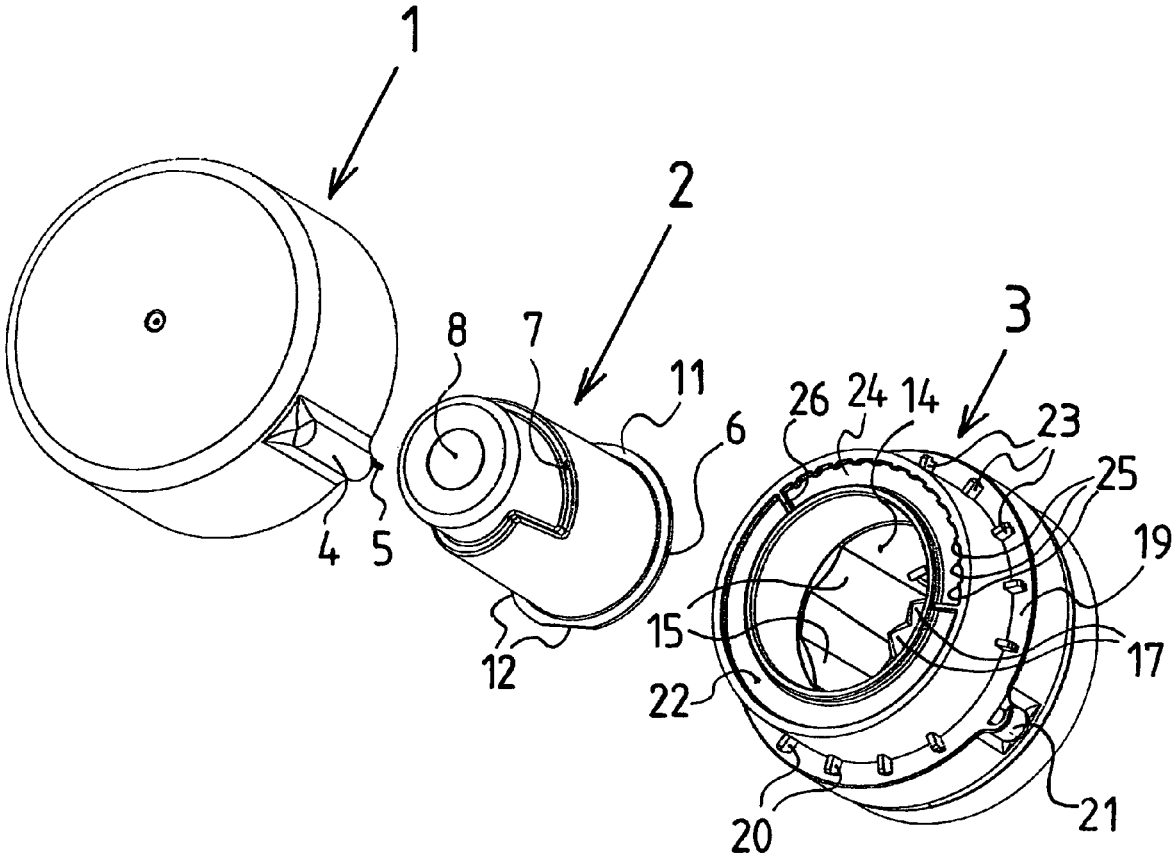
FIG. 2 is an exploded view of individual parts of this first variant of the plastic spout with a rotating cap, a capsule, and a screw-on nozzle with opening sleeve shown separately, viewed diagonally from above.

FIG. 2 shows the parts of this first variant of the plastic spout with the rotating cap 1, the capsule 2, and the screw-on nozzle 3 with the opening sleeve 14, seen diagonally from above. One can see here the bulge 4 at the cap margin with the shear pin 5 projecting downward. Below the rotating cap 1, the overturned capsule 2 is shown. The helical collar 7 of the cap base 8 forms a slide curve that acts together with the helical margin 10 of the guide sleeve 28 inside the cap 1 for opening the capsule 2. This guide sleeve 28 can be seen in FIG. 1. Below the capsule 2, the radial projecting edge 11 can be seen, which shows straight or plane sections 12. Below the capsule 2, one can see the screw-on nozzle 3 with the collar 19 and the snap-on cams 20 aligned radially to the outside. On their outermost front side, each of these shows a nose 23 which fit in the groove 18 on the inner side of the cap wall. The shear pin 5 at the lower edge of the cap edge fits into the opening 21 on the outside at the screw-on nozzle 3. The tamperproof guarantee is provided that upon rotating the cap 1 placed on the screw-on nozzle 3, the shear pin 5 fitting in this opening 21 breaks. Alternatively, the opening 21 includes a weak point on its right side that is pierced by the pin 5 that acts as a powerful bolt.

The capsule 2 can thus be placed in the screw-on nozzle 3 or in the opening 14, so that its flat margins 12 on the edge 11 lie opposite to the plane sections 15 inside the opening sleeve 14. It is then held firmly inside the opening sleeve 14. In the lower area of the opening sleeve 14, one can see the piercing and cutting teeth 17 projecting upward. Above on the screw-on nozzle 3 between its outer side and the opening sleeve 14, a material bridge 22 is present that carries the opening sleeve 14 freely hanging inside the screw-on nozzle 3. This bridge forms a peripheral groove 24. In a region that extends by about one-fourth to one-third or more of the circumference of this groove 24, its outer limiting wall is provided with a series of barbs 25. These barbs 25 act together with a handle 27 that sticks out on the lower side of the cap 1 and is visible in FIG. 3. Together with these barbs 25, this handle 27 forms a ratchet. This ensures that the cap 1 can be rotated only in the counter-clockwise direction from its starting position when its shear pin 5 in the opening 21 and that this rotation is restricted by a cross-plate 26 in the groove 24. When the cap 1 is rotated so far once, that the handle 27 at the cap 1 is stopped at the cross-plate 26. The cap 1 then can no longer be rotated back from this end position because of the barbs 25.

Figure 3:
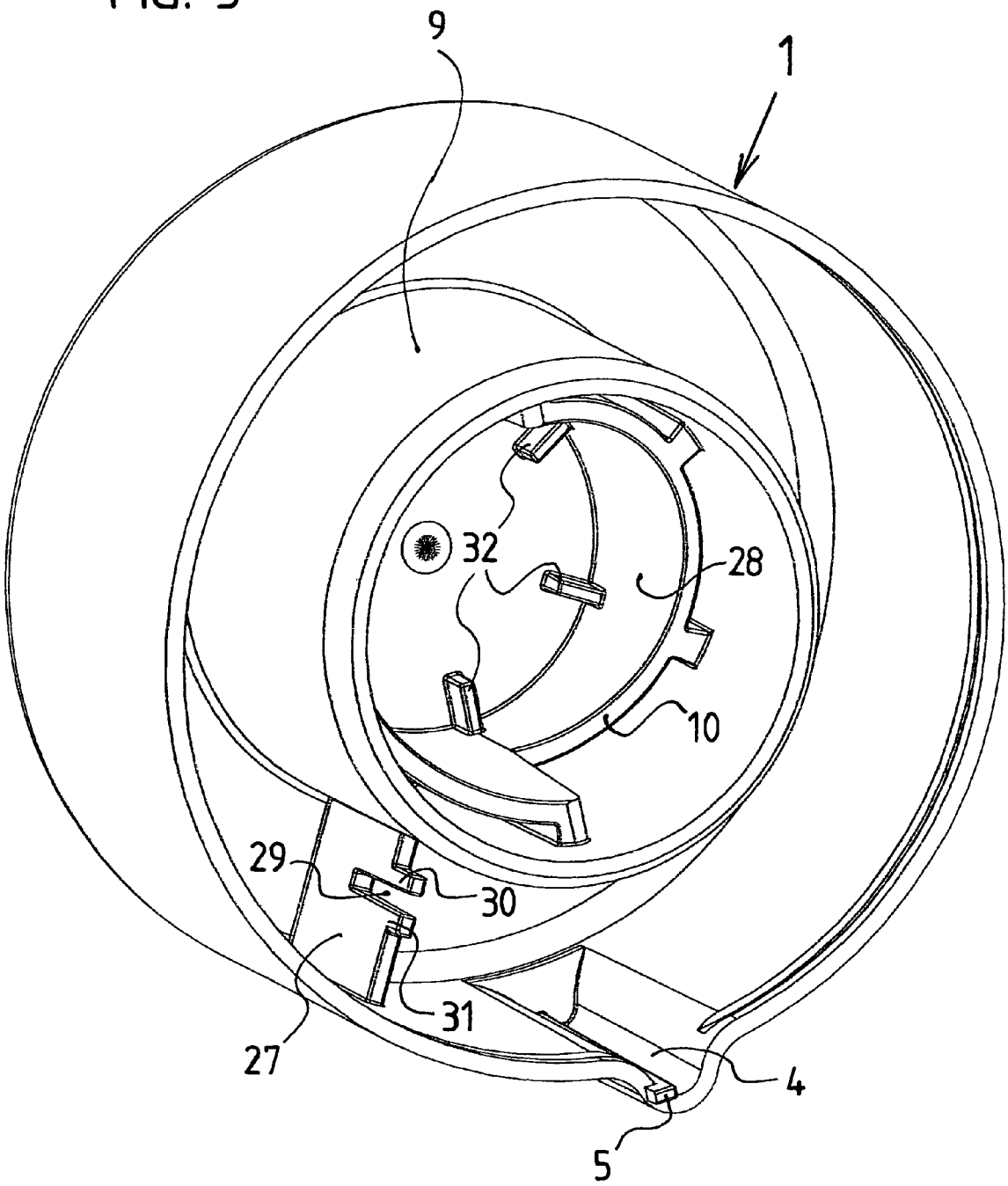
FIG. 3 is a perspective view of the rotating cap viewed diagonally from below in a magnified view.

FIG. 3 shows the rotating cap 1 diagonally from below in a magnified view. One can see the handle 27 that is formed between the outer wall of the cap 1 and the sleeve 9 and within which the guide sleeve 28 is formed with its helical outer margin 10. This handle 27 runs in two cams 30, 31 aligned in axial direction and separated by a slit 29. When the cap 1 is placed over the screw-on nozzle 3 and is rotated in the direction of opening, the inner cams 30 slide along the inner limiting wall of the groove 24 while the outer cams 31 slide over the barbs 25 at the outer limiting wall of the groove 24. The slit 29 between both the cams 30, 31 allows the cam 31 to yield a little against the center of the cap 1 and hence maneuver above the barbs 25. The cam 31 then jumps back behind each barb 25 and slides again along the length of the outer limiting wall of the groove 24 until the handle 27 finally comes to a stop at the cross-plate 26 in the groove 24. In this display of the cap 1, one can see also the shear pin 5 in the bulge 4 as well as the guide sleeve 28 with two sections of helical edges 10. The radial ribs 32 on the base of the cap are used for positioning the capsule 2 when it is inserted with its base on the front inside the cap. The base of the capsule then stands on these ribs 32.

Figure 4:
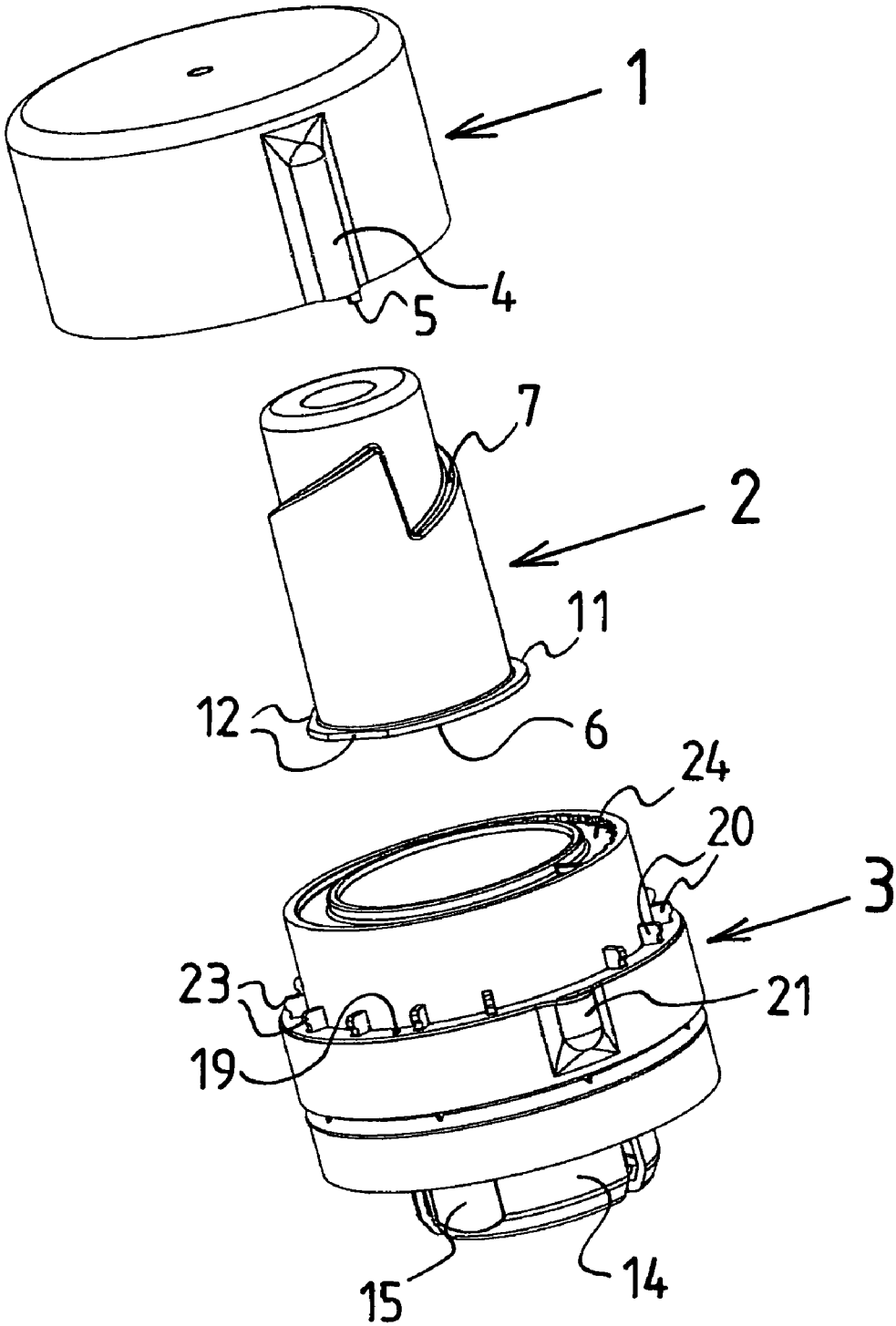
FIG. 4 is an exploded view of the individual parts of this first variant of the plastic spout with a rotating cap, a capsule, and a screw-on nozzle with opening sleeve shown separately, viewed laterally.

FIG. 4 shows the individual parts of this first variant of the plastic spout with the rotating cap 1, the capsule 2, and the screw-on nozzle 3 with an enclosed opening sleeve 14 displayed separately. The helical collars 7 fit over the capsule 2. The capsule 2 disappears with the assembly of the spout inside the screw-on nozzle 3. The plane sections 12 and their protruding edge 11 are led along the plane sections 15 inside the opening sleeve 14 and held firmly therein. In this position, the sealing foil 6 of the capsule is present just above the piercing and cutting teeth 17 at the lower edge of the opening sleeve 14. If the cap 1 is rotated in the direction of the opening, then the capsule 2 must remain in the same rotational position within the opening sleeve 14 while the cap 1 rotates around it. Thereby the helical edges 10 of the guide sleeve 28 inside the cap 1 act on the slide curves of the capsule 2 and push the capsule 2 in a translatory movement downwards within the opening sleeve 14. Thereby, the sealing foil 6 of the capsule 2 is pressed above the piercing and cutting teeth 17 present around the opening sleeve 14. The piercing and cutting teeth thus pierce the foil 6 along its marginal area and cut it such that that the contents of the capsule fall into the container.

Figure 5:
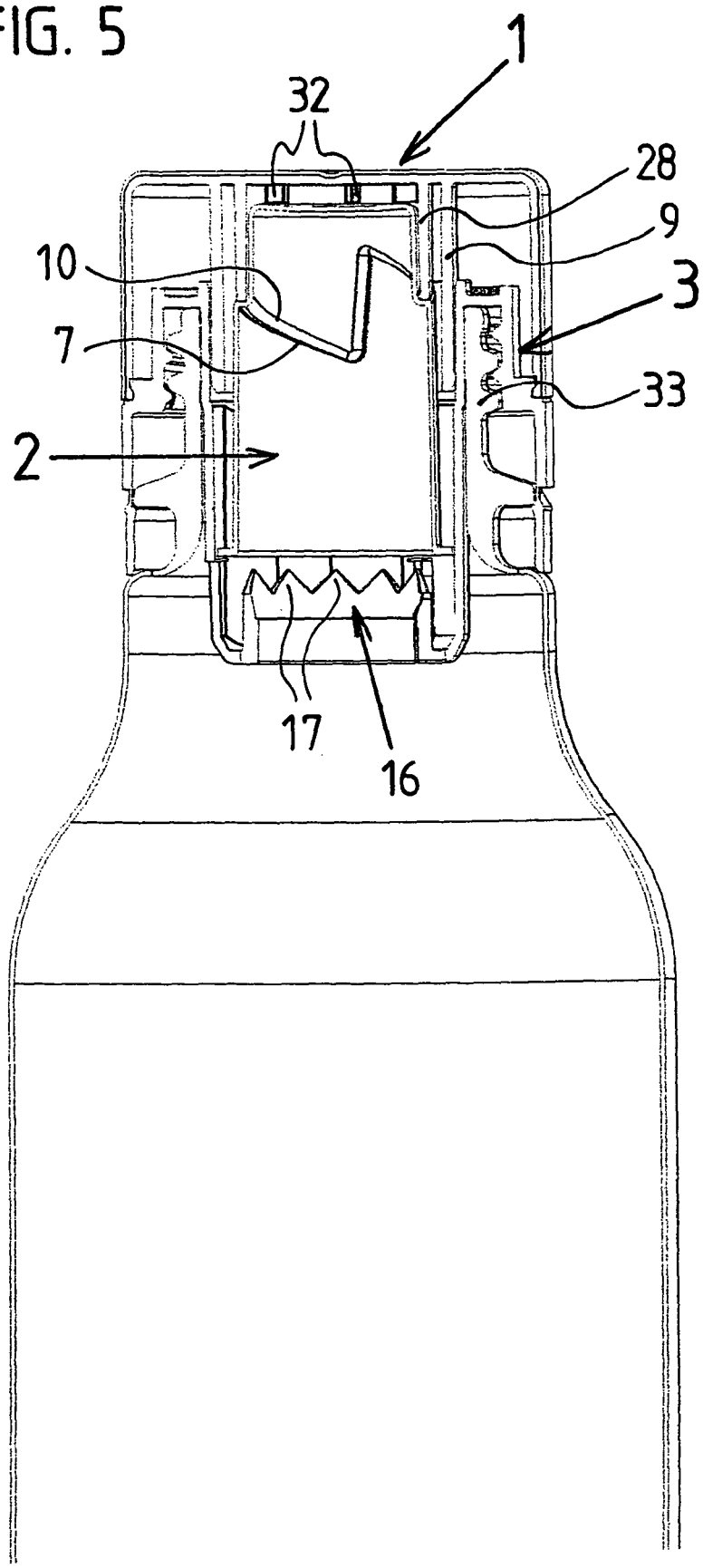
FIG. 5 is a cross-sectional view of the individual parts taken longitudinally along the axis of rotation of the rotating cap, of the capsule, and of the screw-on nozzle with opening sleeve.

FIG. 5 shows the parts of this spout assembled, in a cross-section along the axis of rotation of the rotating cap 1, the capsule 2, and the screw-on nozzle 3 with the opening sleeve 14. The nozzle 3 is screwed on a container nozzle 33. In this display, one sees how the capsule 2 with its helical collar 7 lies as the slide curves 7 at the helical edges 10 of the guide sleeve 28. When the cap is rotated, these edges 10 are rotated over the slide curves at the capsule 2 and force the capsule 2 to move downwards. The capsule 2 is thus pushed downwards within the opening sleeve 14 and its sealing foil 6 is thereby pressed over the piercing and the cutting device 16 so as to pierce the foil and cut it. The contents of the capsule then fall in the container. If the cap 1 is now rotated further, which requires a large torque, then the nozzle 3 is loosened out from the external thread of the container nozzle 33 until the complete spout made of the cap 1, the capsule 2, and the nozzle 3 is removed from the container. The container is then ready for its contents to be poured out, which is now mixed with the substance of capsule 2. After pouring out one dose or the required quantity, the spout with the screw-on nozzle 3 can be screwed back again on the container nozzle 33 like a conventional threaded cap.

Figure 6:
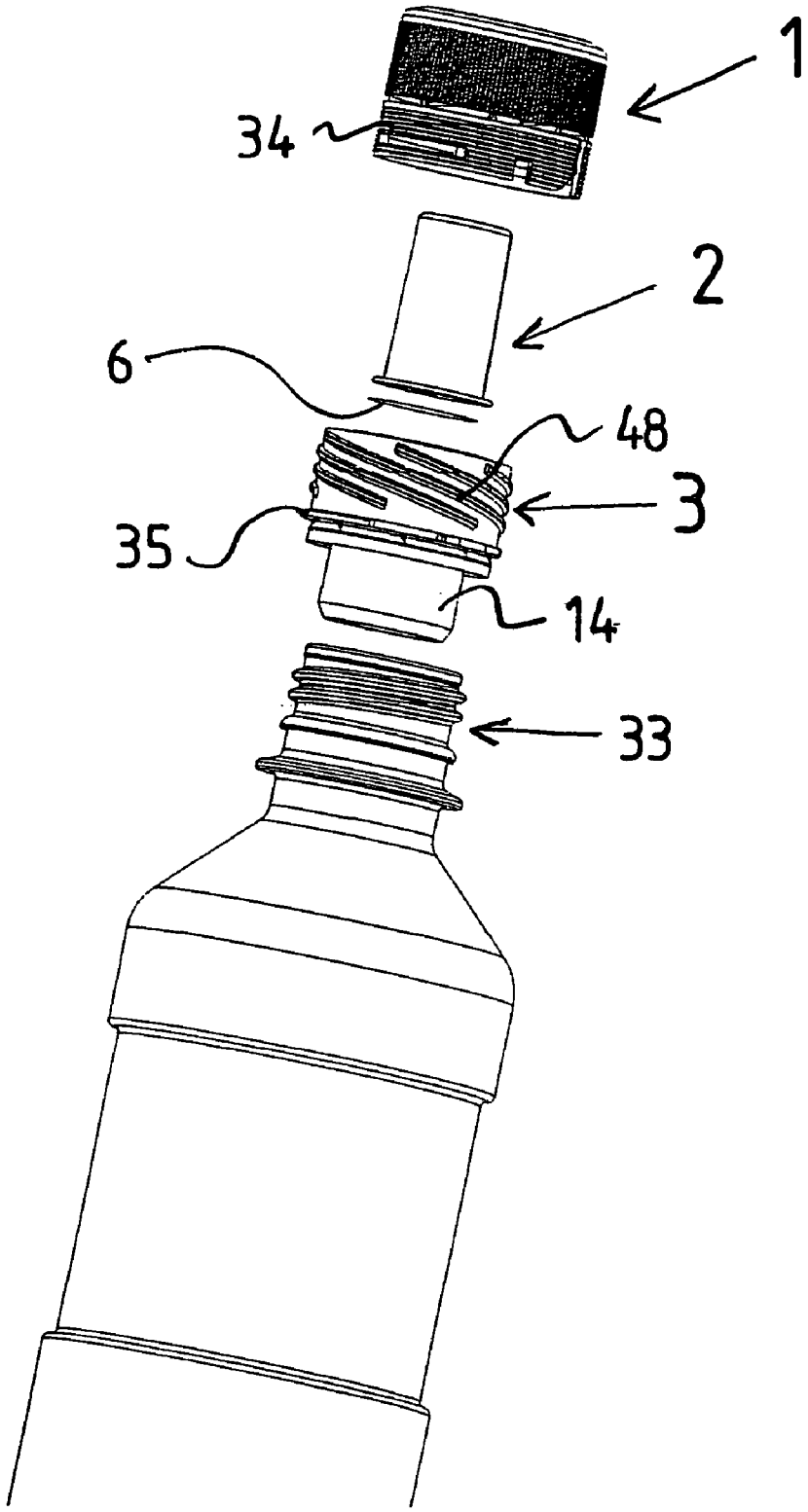
FIG. 6 is an exploded view of the individual parts of a second variant of the plastic spout with a rotating cap, a capsule, a screw-on nozzle and a container bottle, viewed from the side, aligned on their common axis.

A second embodiment variant of this plastic spout is shown in FIG. 6. The container nozzle 33 is designed here as a threaded nozzle with a normal outer thread running clockwise. The screw-on nozzle 3 is rotated and screwed on this threaded nozzle in a clockwise direction. The corresponding threaded nozzle shows a counter-clockwise inner thread. As a special feature, the screw-on nozzle 3 of this second embodiment on shows an outer thread 48 running counter-clockwise. The cap 1 with a counter-clockwise thread is screwed on this outer thread from top in a counter-clockwise movement until a stop is reached that can be removed. This is formed by the fact that the cap 1 shows a guarantee tape 34 at its lower edge formed by fine material bridges. This guarantee tape 34 finds a stop on the protruding collar 35 of the nozzle 3. On the top, the screw nozzle 3 is connected on its margin with the upper margin of an opening sleeve 14 running coaxially to it and having a small diameter via a radial bridge. This opening sleeve 14 fits in the inside of the container nozzle 33. At its lower end, it shows a piercing and cutting device having piercing and cutting teeth projecting upward on the inner side.

In the lower side of the cap 1, the capsule 2 at first opens on its downside, fills separately with a substance, and thereafter sealed with a foil 6 that is pushed inside and held firmly. This capsule 2 can be formed directly on the base of the cap 1. By overturning the cap 1, the capsule 2 is filled and sealed. When the spout is mounted on the container nozzle 33, then this capsule 2 protrudes on the inside of the container nozzle 33, such that the sealing foil 6 of the capsule 2 lies just above the piercing and cutting device. With the removal of the guarantee tape 34, there arises a gap between the lower edge of the cap 1 and the protruding collar 35 at the nozzle 3. The cap 1 can be screwed further downwards by a rotation in the counter-clockwise direction. The capsule 2 rotates with the cap 1 and is thus rotated downwards over the piercing and cutting device so as to pierce and cut the foil 6. Thereafter, the contents of the capsule fall into the container. Finally, the cap 1 hits with its lower edge on the collar 35 of the nozzle 3 and cannot be screwed down any further. If the capsule 1 is rotated further in the counter-clockwise direction with additional torque, it then takes the nozzle 3 along with it and is loosened out from the thread of the container nozzle 33. The complete spout together with the capsule 1 and the nozzle 3 is thus loosened out from the container nozzle 33 and removed. The container is ready for pouring out the contents now mixed with the substance.

Figure 7:
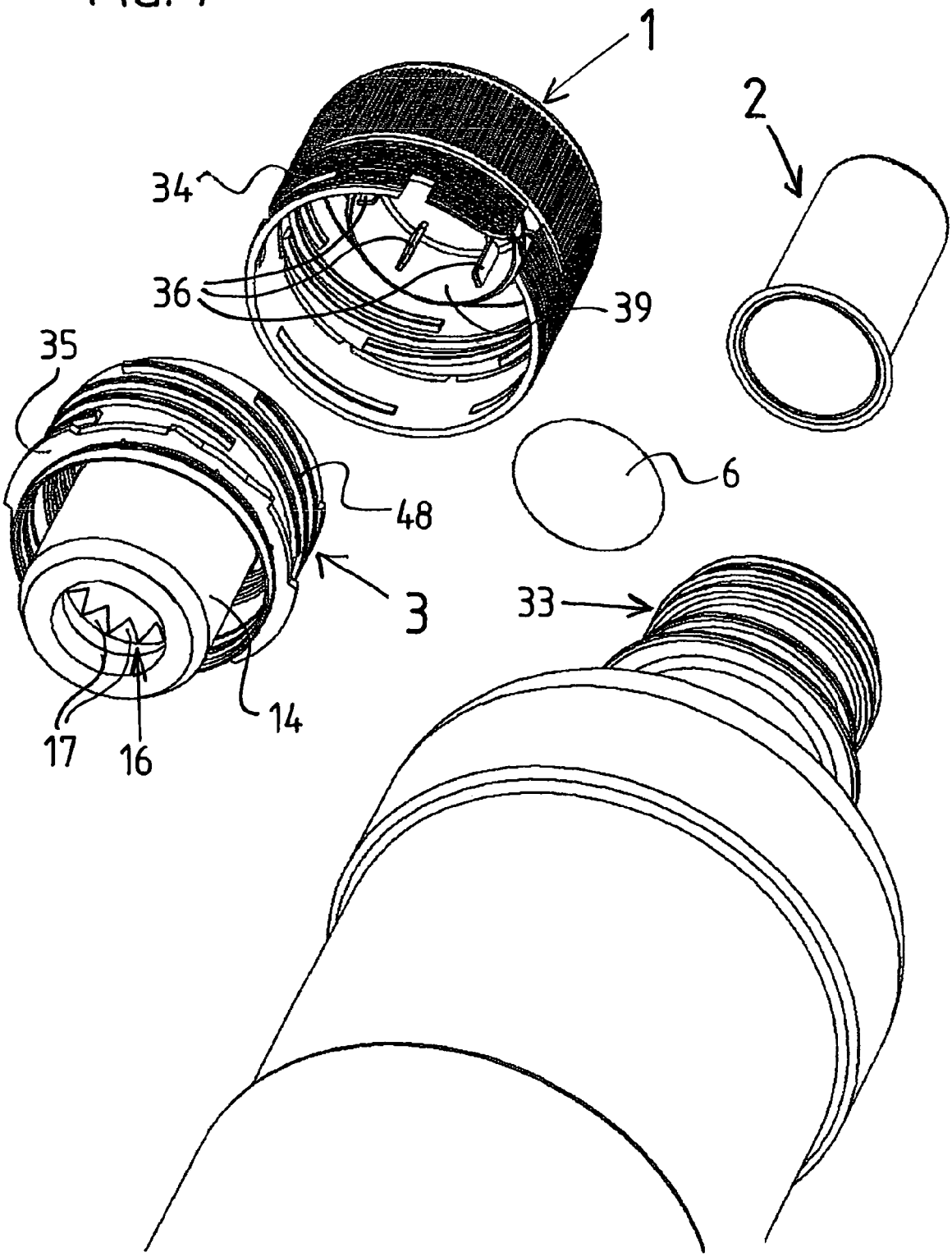
FIG. 7 is an exploded view of the individual parts of the plastic spout as per FIG. 6.

FIG. 7 shows a perspective view of the individual parts of this spout, in a view seen diagonally from below. One can see the radially aligned ribs 36 inside the cap 1 that are formed on a retaining ring 39 and within which the capsule 2 and the substance are retained. At the lower edge of the cap 1, the guarantee tape 34 running around can be seen. On the right near the cap 1 is the capsule 2 with the sealing foil 6. The capsule 2 with its opening is first filled and aligned upward and thereafter the sealing foil 6 is sealed or welded such that the capsule 2 is sealed. The capsule 2 is then mounted in an overturned position in the cap 1, i.e., with the foil 6 downwards and aligned with its base in the direction of the open side of the cap. Below the cap 1, the nozzle 3 can be seen. This shows an outer thread 48 running counter-clockwise as the inner thread of the cap 1 is run counter-clockwise. If the cap 1 is rotated to the left as seen from above, i.e., in the counter-clockwise direction, then it is screwed on the nozzle 3 until its guarantee tape 7 reaches till the collar 35. The opening sleeve 14 protrudes out of the nozzle 3 from below. The capsule 2 comes to lie in the inside of this sleeve 14 from the top. One can see the piercing and the cutting device 16. To the right near the nozzle 3, the container is shown with the related container nozzle 33.

Figure 8:
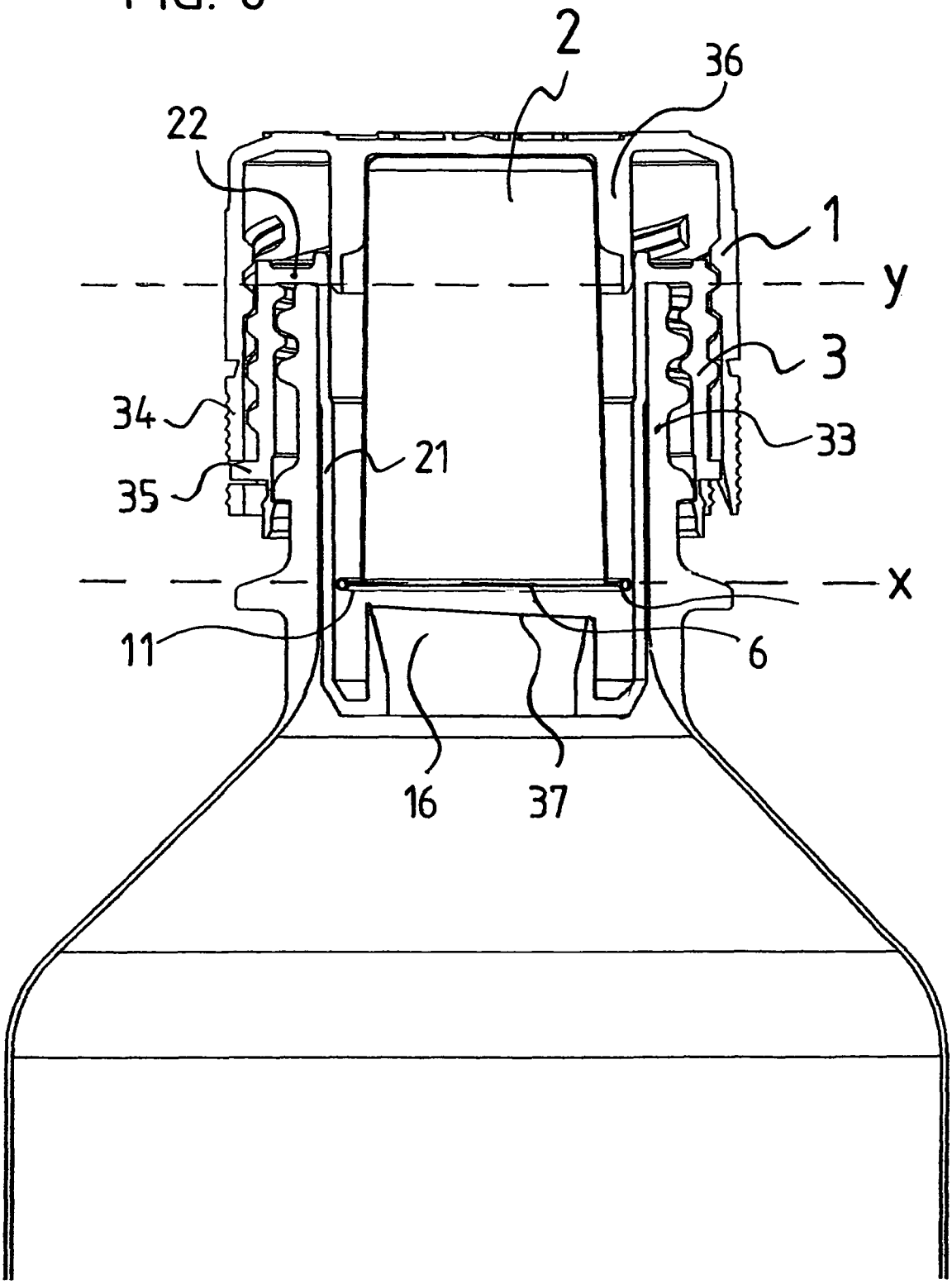
FIG. 8 is a cross-sectional view of this plastic spout mounted on a container with the container nozzle required for spouting, taken longitudinally along the axis of rotation.

FIG. 8 shows this spout mounted as per FIG. 7, in a cross-section along its axis of rotation. One can see the nozzle 3 that is connected on with the opening sleeve 14 via the radial bridge 22. This opening sleeve 14 is longer than the nozzle 3 and protrudes out from the same. On its lower edge, it carries the piercing and the cutting device 16 connected with it in one piece. This forms at least one upward tooth and one slightly aligned cutting tooth 37. In the given situation, the guarantee tape 34 of the cap 1 lies on the collar 35 at the nozzle 3. The straight dashed line y shows the position of the upper margin of the container nozzle 33 and the straight dashed line x shows the position of the lower edge 11 of the inserted capsule 2 with its sealing foil 6. As one can see, this lower edge 11 lies clearly below the upper margin of the container nozzle 33. In other words, the capsule 2 is integrated in the inside of the container nozzle 33 such that it does not make the spout any bigger than a usual rotating or lid cap. If the guarantee tape 34 is now torn away, then the rotating cap 1 first can be screwed further downwards by a left movement. It takes along with it the capsule 2 downwards, rotates it along with it, and finally presses it in a rotating way with its foil 6 over the piercing and cutting device 16. The foil 6 is thus pierced and cut with the rotating movement of the cutting tooth 37. This opening process goes on until the lower edge of the cap 1 at the collar 35 is present on the nozzle 3.

Figure 9:
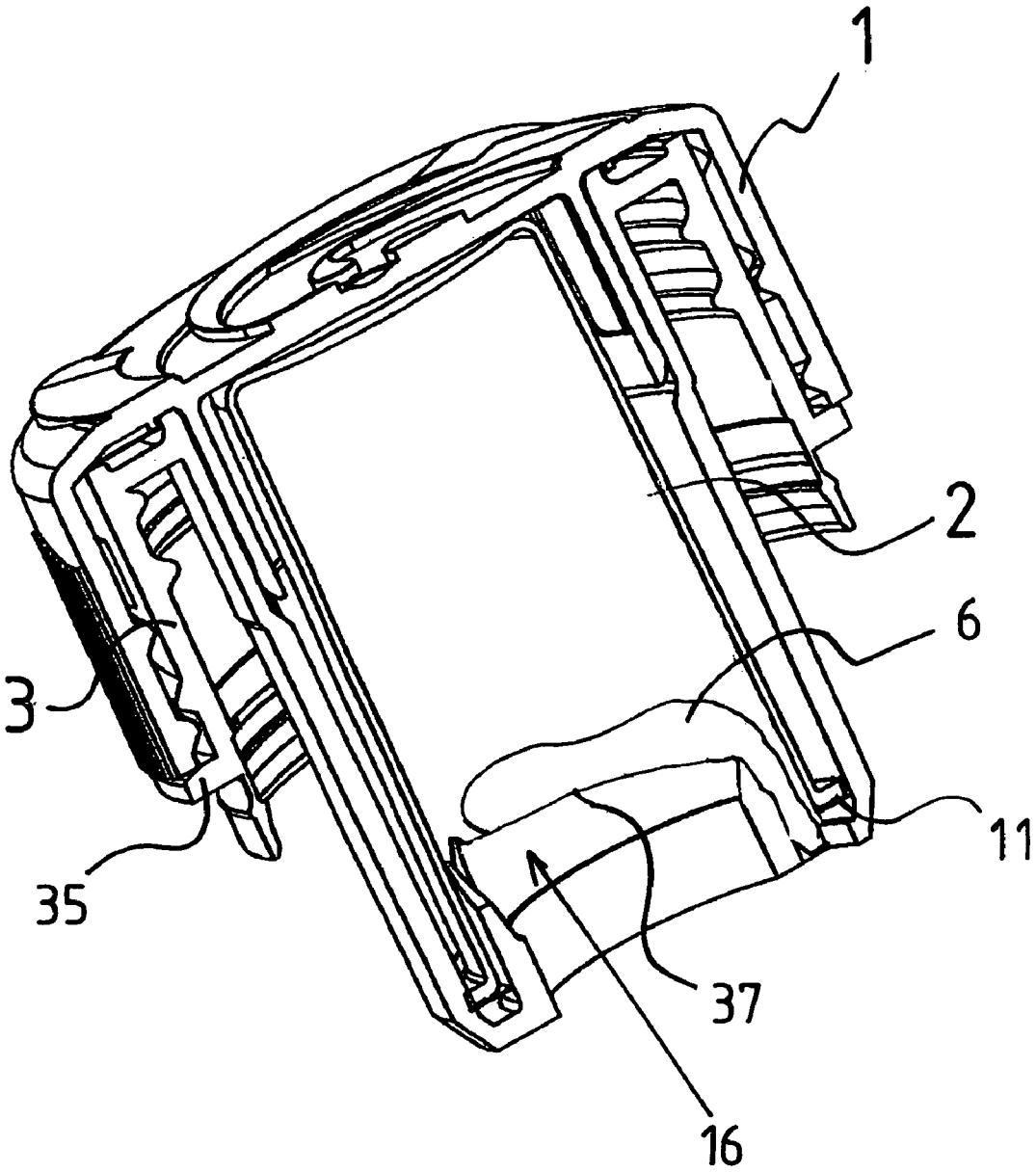
FIG. 9 is a cross-sectional view of the rotating cap and the capsule of the plastic spout, taken longitudinally along the axis of rotation.

This situation with the cut foil piece 6 is shown in FIG. 9. The cap 1 now finds a stop at the collar 35. If the cap is now rotated further left out of this position, then it takes the nozzle 3 forcefully along with it, whereby the same is loosened out from the container nozzle 33. However, the entire plastic spout is now loosened from the container nozzle 33 together with the now empty capsule 2. The spout can be screwed again on to this container nozzle such that the container can be sealed airtight again.

Figure 10:
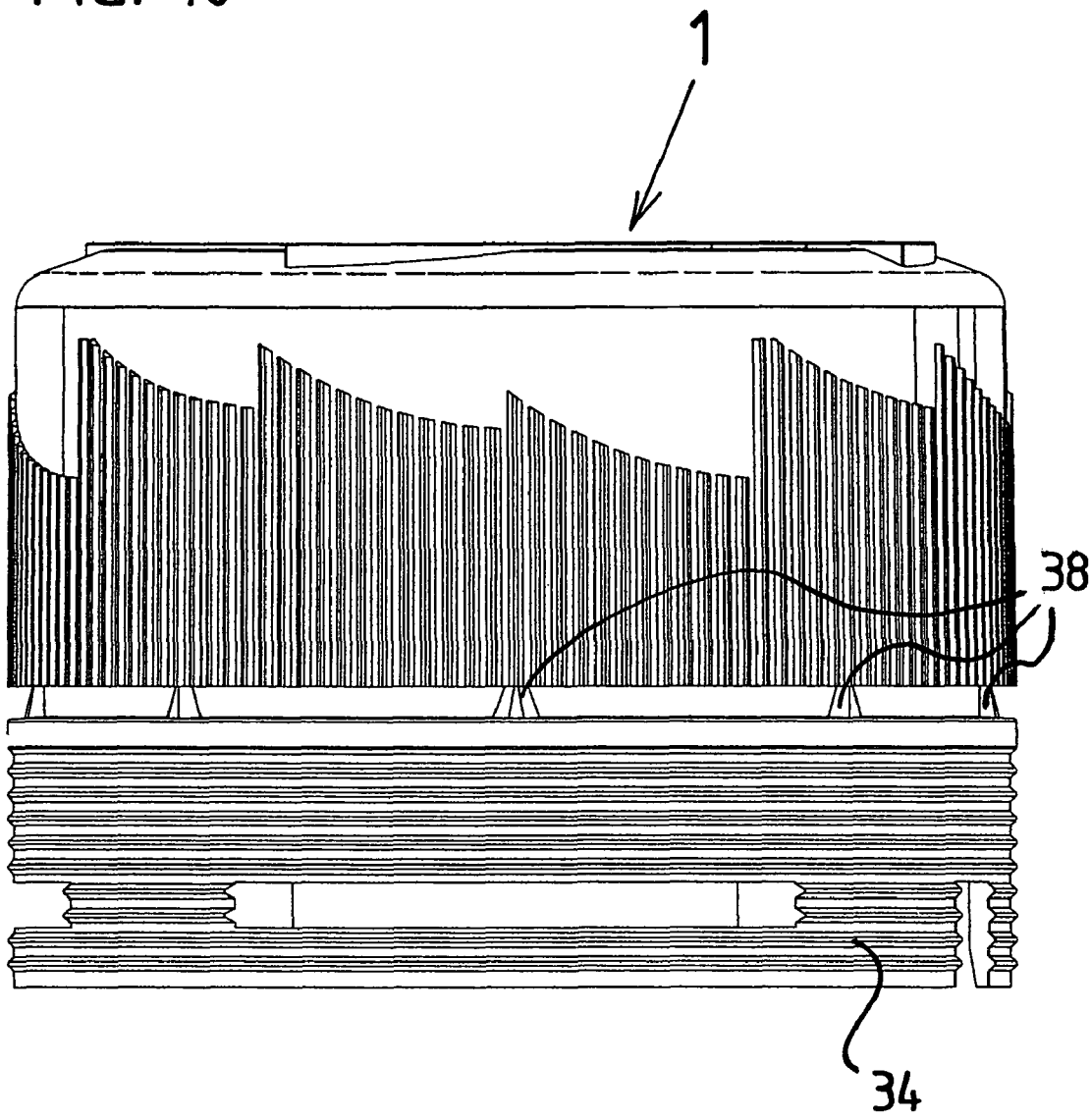
FIG. 10 is an exploded view of the rotating cap with the guarantee tape and the associated screw-on nozzle viewed diagonally from above.

FIG. 10 shows the cap 1 with its guarantee tape 34 at the lower edge of the cap 1. This guarantee tape 34 is fixed in the normal way via a few material bridges or via a continuous thin point 38 as a predetermined breaking point at the lower cap margin. As one can show in the Figure, a number of windows 49 are distributed in length along the periphery. At one end of the guarantee tape 34, this forms a gripping surface 50 which can be folded outside for tearing away the guarantee tape. At the related nozzle 3 with its counter-clockwise rotating outer thread 48, the collar 35 can be seen. This forms radial projections 51, protruding outwards, and bevelled at its upper side. The projections 51 fit in the window 49 when the cap 1 is set such that the cap 1 is safeguarded on all sides on the nozzle 3. Through this solution with these windows 49 in the guarantee tape 34, the height of the spout can be reduced vis-à-vis a solution in which the guarantee tape 34 is present with its lower edge on a projection. At the nozzle 3 at the collar 35, a radial cam 52 is formed that fits in the clearance 53 at the lower edge of the guarantee tape 34. The cam 52 serves as an additional safeguard against rotation.

Figure 11:
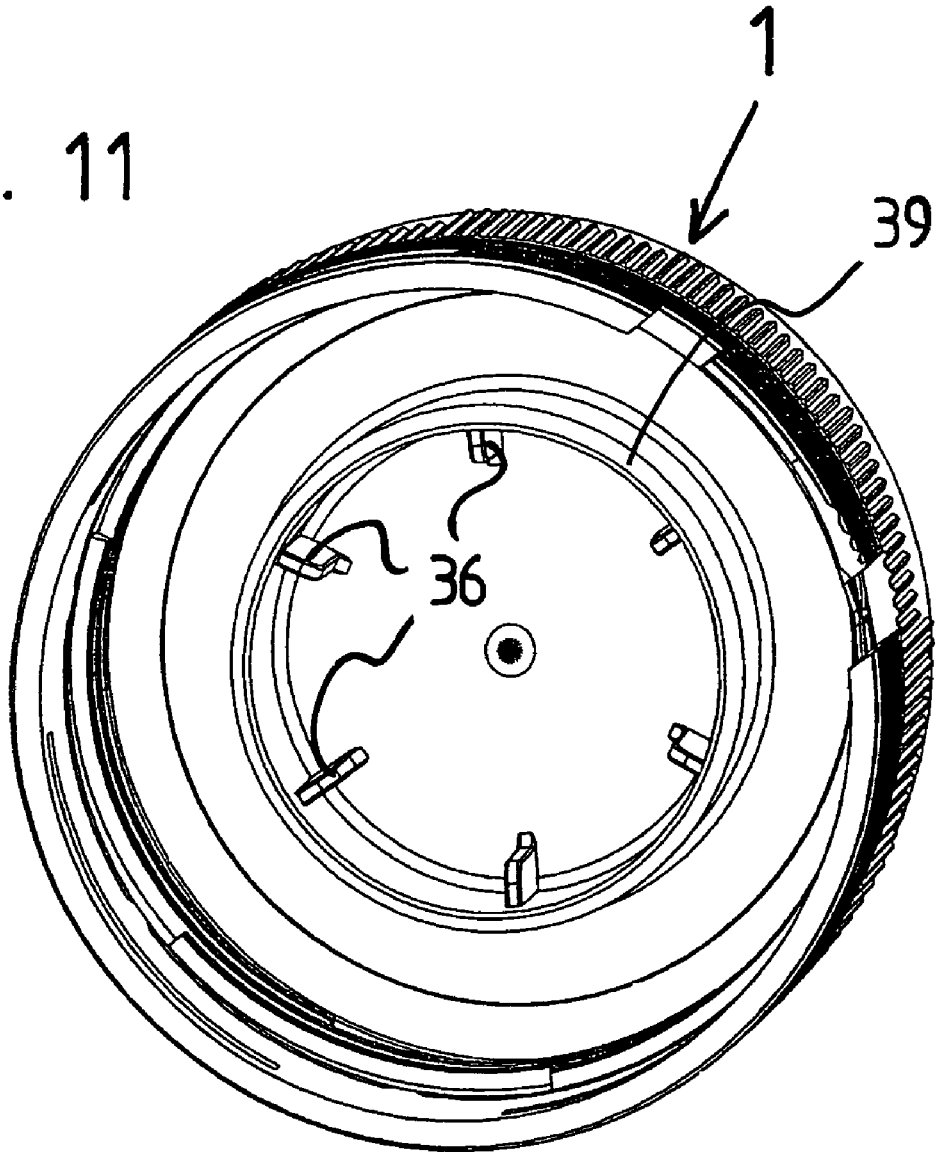
FIG. 11 is a perspective view of the rotating cap with the guarantee tape viewed from below.
Figure 12:
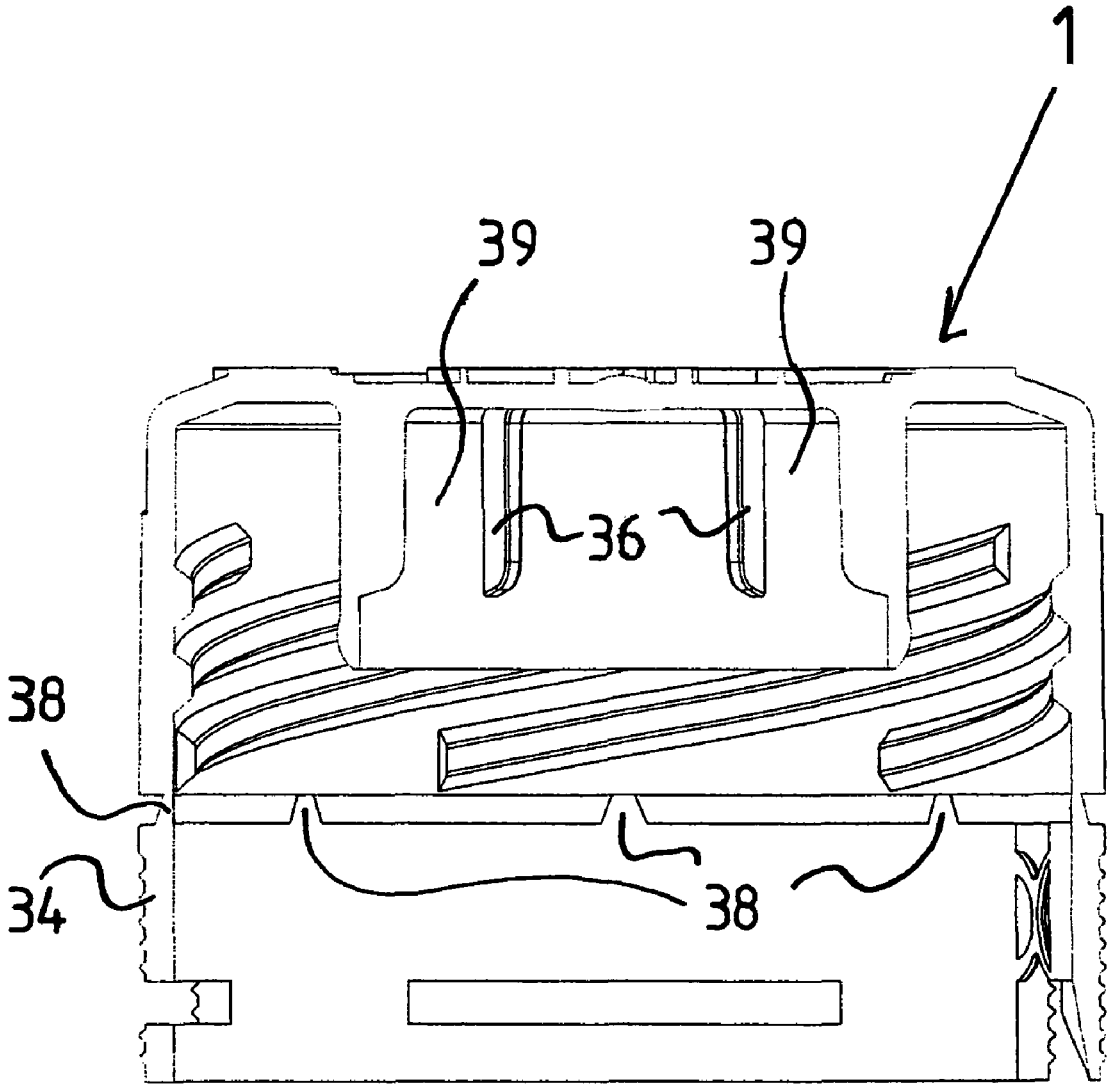
FIG. 12 is a cross-sectional view of the rotating cap with the guarantee tape viewed from the side.

In FIG. 11 the cap 1 is depicted as shown from below. One can see the ribs 36 running radially inside the retaining ring 39 that are formed at the lower side of the cap lid. These ribs 36 serve for fixing the filled and the sealed capsule 2 when these are pressed with their base in the retaining ring 39. FIG. 12 shows the cap 1 seen from the side in a cross-section through its rotating axis. One recognises the retaining ring 39, which is formed at the inner side of the cap lid, as well as ribs 36 formed radially inwards. The guarantee band 34 can be seen below the cap 1, which is held at the lower cap margin via the material bridges or a continuous thin point 38.

Figure 13:
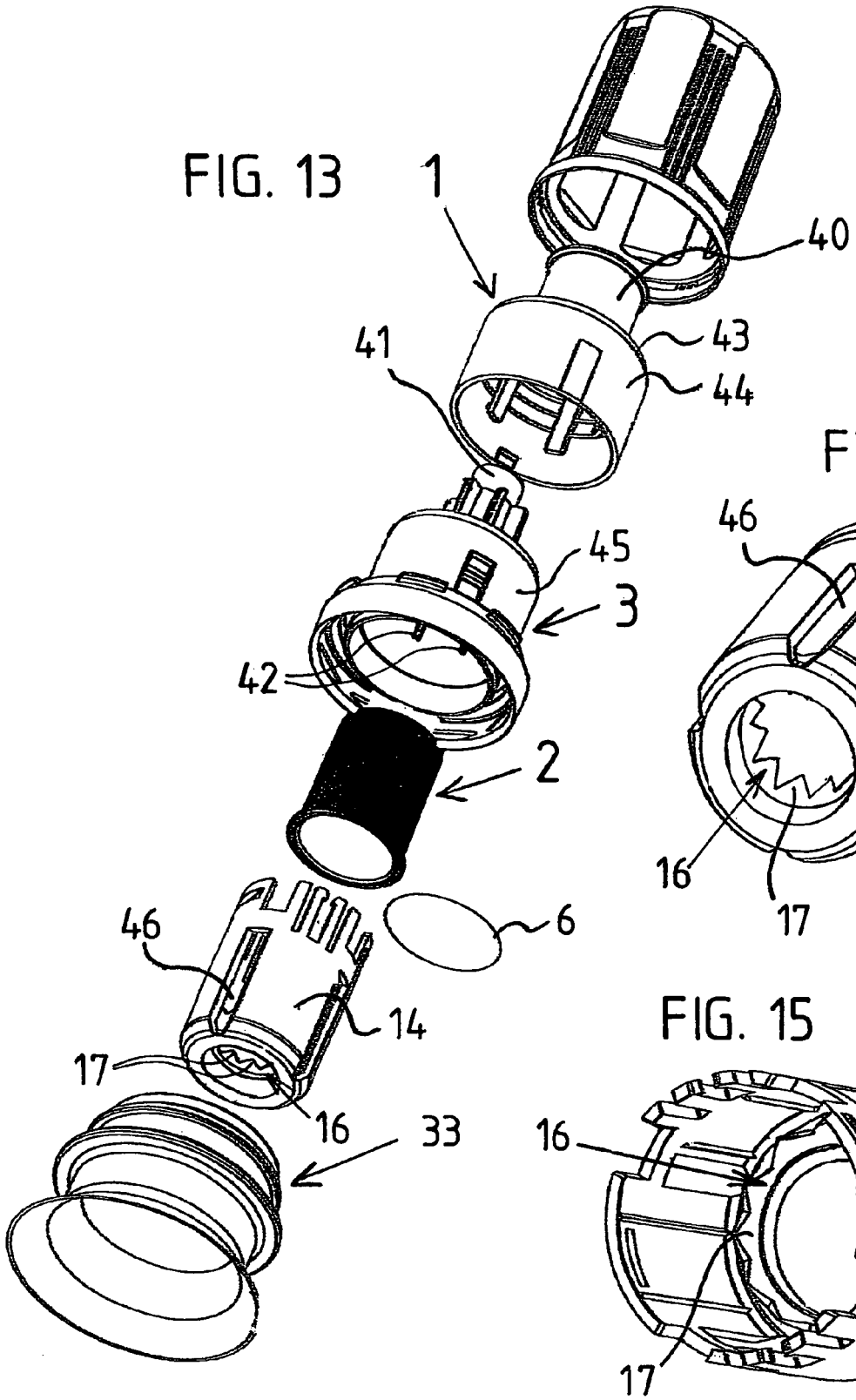
FIG. 13 is an exploded view of the individual parts of a third variant of the plastic spout in the form of a sports or drink closure where the individual parts are aligned on their common axis.

FIG. 13 shows a third embodiment of the plastic spout in the form of a sports or drink closure. The individual parts are dismantled and showed in perspective view. The individual parts are thereby aligned on their common axis. The spout includes six parts. The part acting as the cap 1 is designed as a drink closure. The cap 1 forms a drink nozzle 40 that cooperates with a coaxially arranged stopper 41 of another part that acts as the screw-on nozzle 3. Inside this nozzle, a number of ribs 42 are aligned radially inwards. The capsule 2 with its capsule base, i.e. with its sealing foil 6 downward, is held fixed. The cap 1 shows a collar 43 that runs above in the drink nozzle 40 and forms against it a sleeve 44. This sleeve 44 is positioned over on the nozzle 3 via a guide nozzle 45, which is fixed in a sealing way on the container nozzle 33 as shown in the example. Within this guide nozzle 45 is an opening sleeve 14 with clearances 46 running axially in the outer wall. At the lower end of this opening sleeve 14 is a piercing and cutting device 16 with upwardly aligned piercing and cutting teeth 17. The capsule 2 with its sealing foil 6 is set downward in the opening sleeve against the piercing and cutting device 14 such that when the stopper 41 is pressed down, the capsule 2 with its foil 6 is pressed against the piercing and cutting unit 16.

Figure 14:
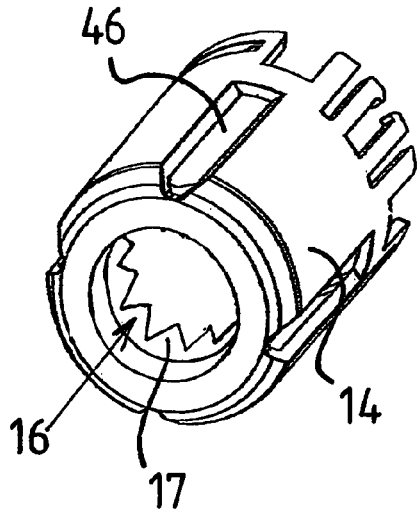
FIG. 14 is a perceptive view of the opening sleeve for the capsule belonging to the plastic spout as per FIG. 13, viewed diagonally from below.
Figure 15:
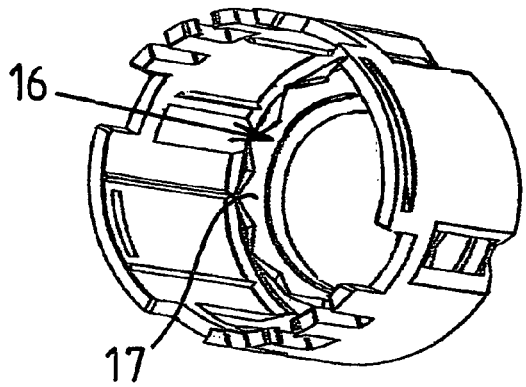
FIG. 15 is a perspective view of the opening sleeve for the capsule belonging to the plastic spout as per FIG. 13, viewed diagonally from above.

FIG. 14 shows the receiving sleeve 14. At its lower edge, one can see the piercing and the cutting device 16. Outside on the opening sleeve 14, a number of channels 46 are present such that the liquid can flow out when the drink spout is opened. In FIG. 15, one sees the opening sleeve 14 from the top. Here one can see the individual teeth 17 of the piercing and cutting device 16.

Figure 16:
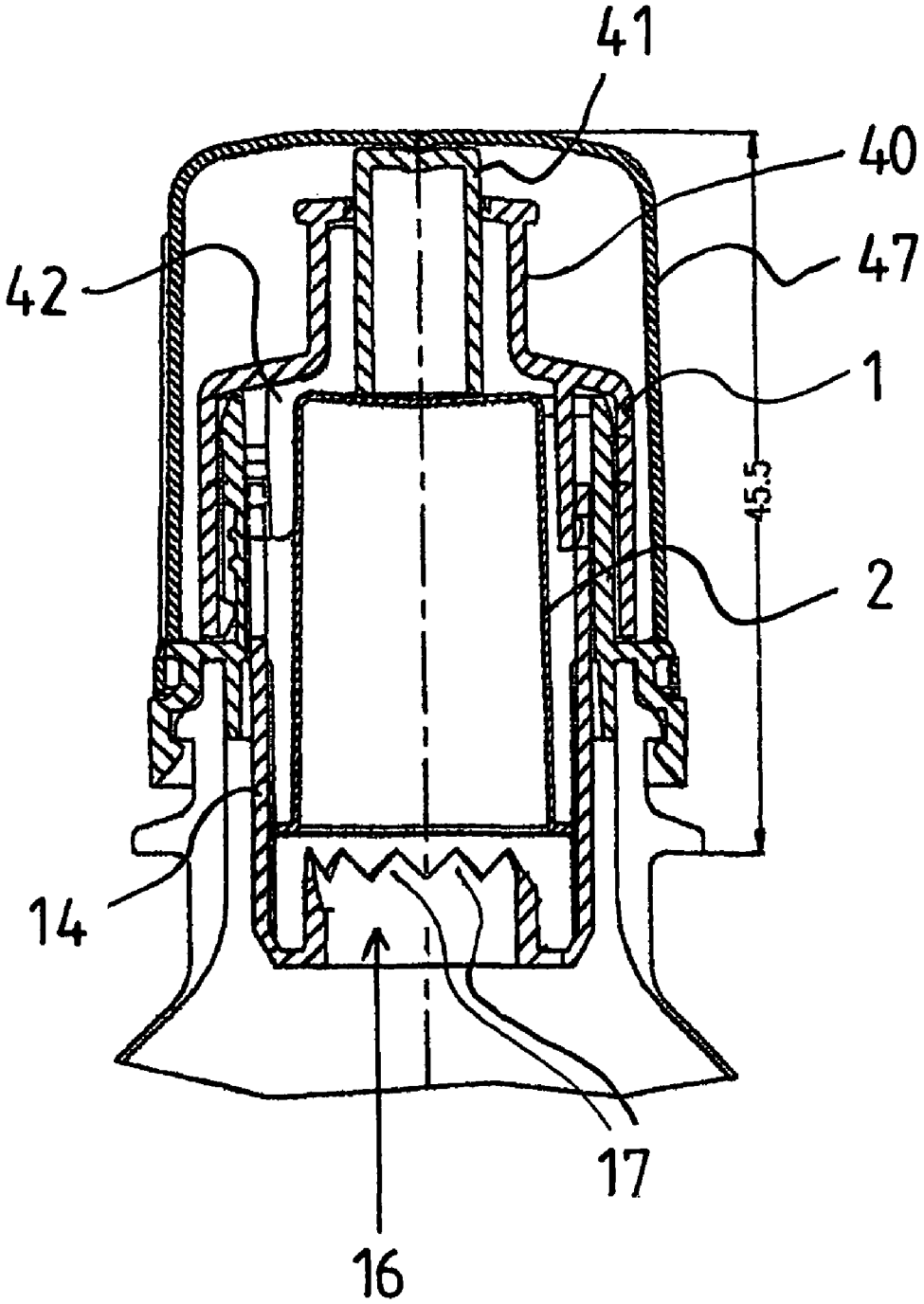
FIG. 16 is a cross-sectional view of the plastic spout as per FIG. 13 taken along its axis, in a mounted and closed, but not yet opened state.
Figure 17:
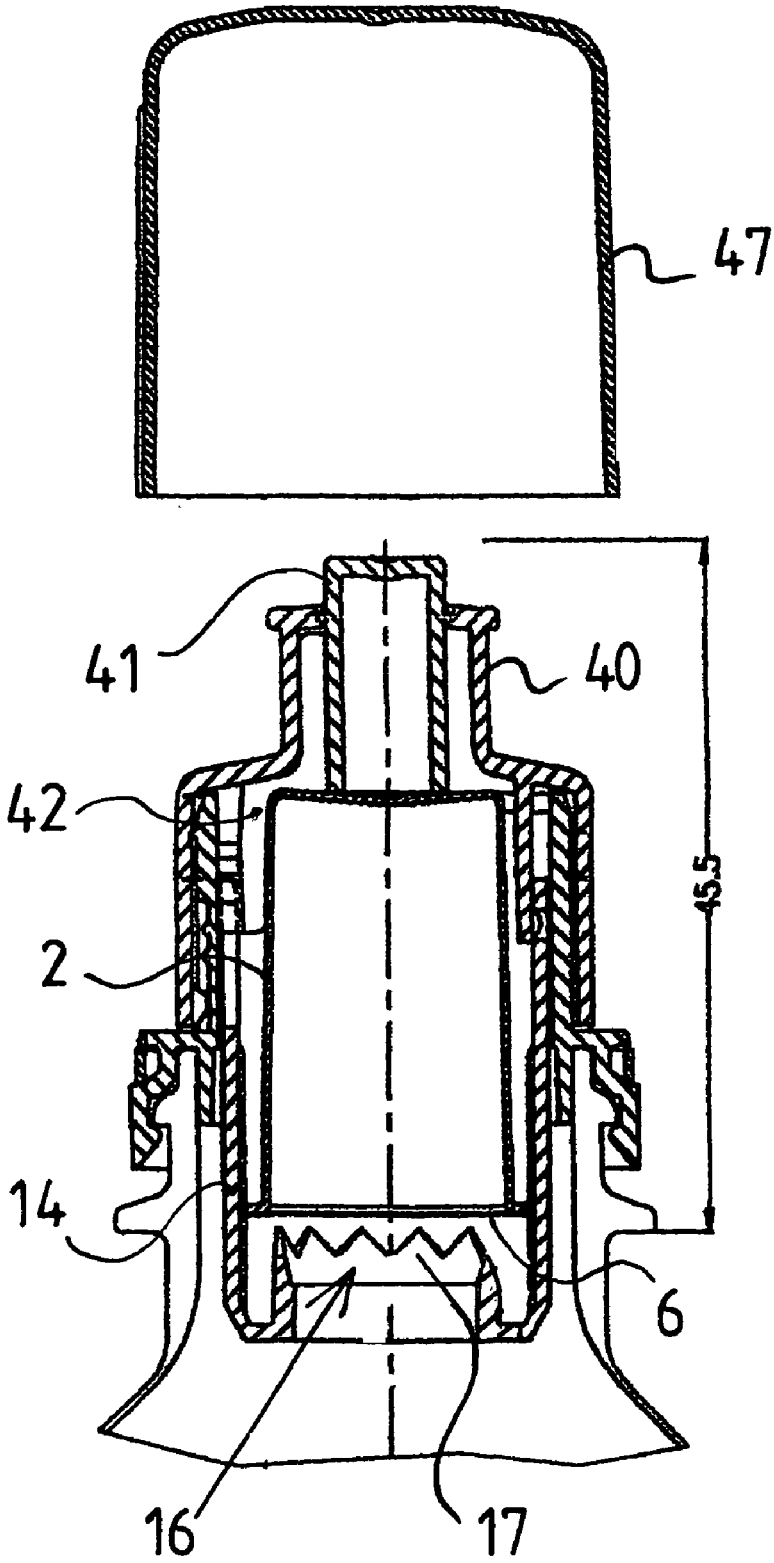
FIG. 17 is a cross-sectional view of the plastic spout as per FIG. 13 taken along its axis, with the protective cap removed, before the dispensing of the substance in the capsule.
Figure 18:
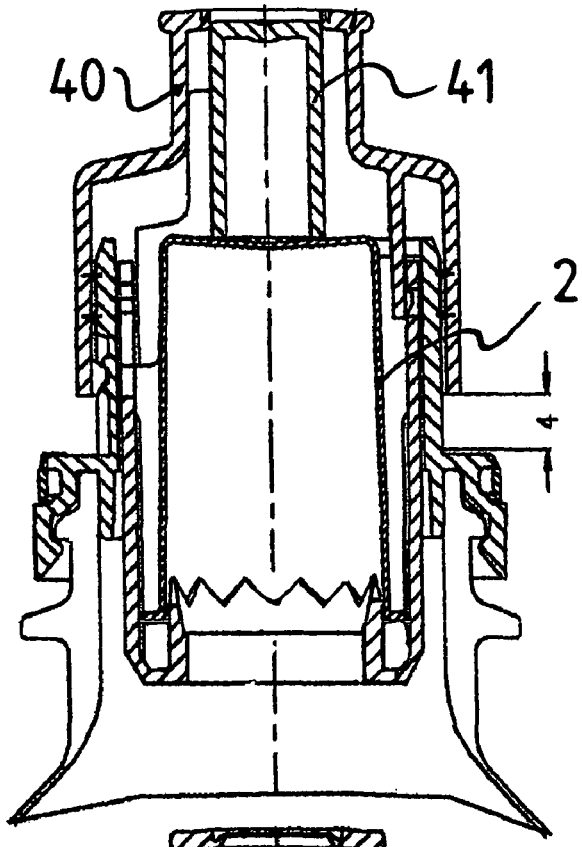
FIG. 18 is a cross-sectional view of the plastic spout as per FIG. 13 taken along its axis, after pressing down the stopper and thus opening the capsule and dispensing its contents in the container, however, in the closing position of the drinking nozzle.
Figure 19:
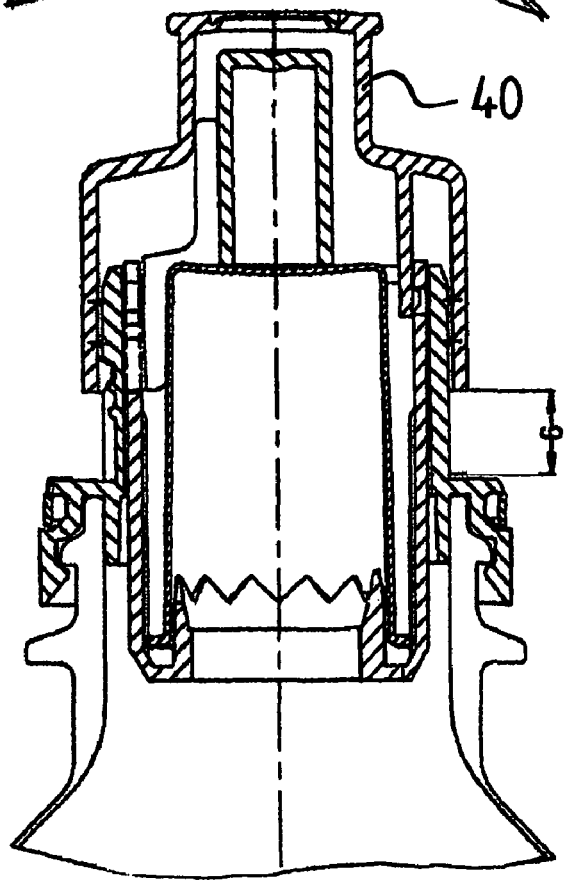
FIG. 19 is a cross-sectional view of the plastic spout as per FIG. 13 taken along its axis, after pressing down the stopper and thus opening the capsule and dispensing its contents in the container, now in the open position of the drinking nozzle.

FIG. 16 shows the plastic spout in the mounted state in the initial position. A protective cap 47 also is placed over the cap 1. The stopper 41 protrudes through the opening of the mouthpiece 40 and seals this opening. The capsule 2 inside the opening sleeve 14 is inserted from below and is held on the top by the ribs 42 and is sealed by the sealing foil 6 on the bottom. Below the foil 6 of the capsule 2, the piercing and the cutting device 16 formed at the lower end of the opening sleeve 14 is present. For opening the spout, the protective cap 47 is first removed as shown in FIG. 17. One can now press with a finger on the stopper 41. As a result of which, the capsule 2 is pressed downwards in the opening sleeve 14 and its foil 6 is pressed over the piercing and cutting device. The foil 6 is thereby pierced and cut as is shown in FIG. 18. The capsule 2 is now open and its content can now flow down into the container. The drink nozzle 40 here is already pulled upwards in a locking position by about 4 mm or so. In this position, the stopper 41 closes the opening in the drink nozzle 40. For opening the drink spout, the cap 1 must be pulled further up until the topmost locking position, which is then pulled out by a total of about 6 mm or so. This is shown in FIG. 19. In this position, the spout is ready to be set with the drink nozzle 40 at the mouth. By pushing back the drink nozzle 40, the spout can be sealed closed again.

FIG. 20 shows this spout with a somewhat longer designed drink nozzle 40 in the closed position. The drink nozzle 40 is pushed back so far that the stopper 41 projects in the opening and closes it. FIG. 21 shows this drink nozzle 40 in the open position. FIG. 22 shows a position rotated by a few degrees along the axis such that the liquid flowing out is shown by arrows. The liquid flows along the clearances 46 in the opening sleeve 14, reaches the guide nozzles 45, flows in to the stopper 41, and finally flows outside through the opening in the drink nozzle 40.

It should be apparent that the foregoing relates only to the preferred embodiments of the present application and that numerous changes and modifications may be made herein by one of ordinary skill in the art without departing from the general spirit and scope of the invention as defined by the following claims and the equivalents thereof.

We claim:

1. A spout for an associated container for dispensing a substance into the container, comprising:

a cap;

a capsule that can be filled, the filled capsule sealed with a sealing layer;

the capsule comprising a helical collar and the cap comprising a helical margin for rotation therewith;

a nozzle that can be screwed onto the container in a first direction, the nozzle carries a piercing device protruding therein;

wherein the sealing layer of the capsule is pierced by the piercing device upon the turning of the cap in a second direction until the cap meets the nozzle at a stop; and wherein further turning of the cap in the second direction removes the cap and the nozzle from the container.

2. The spout of claim 1, wherein the spout comprises a plastic spout.

3. The spout of claim 1, wherein the capsule is aligned downwards within the cap.

4. The spout of claim 1, wherein the capsule is aligned downwards within the nozzle.

5. The spout of claim 1, wherein the nozzle comprises an opening sleeve that stretches inside the container.

6. The spout of claim 5, wherein the opening sleeve comprises the piercing device.

7. The spout of claim 1, wherein the piercing device comprises a piercing and cutting tooth.

8. The spout of claim 1, wherein the piercing device comprises a cutting tooth.

9. The spout of claim 5, wherein the capsule comprises a plurality of straight sections and the opening sleeve comprises a plurality of plane sides such that the capsule can be inserted in the opening sleeve only from the top.

10. The spout of claim 9, wherein the cap comprises a groove and the nozzle comprises a collar on which a plurality of snap-on cams or continuous snap-on beads are formed such that the cap cannot be displaced in an axial direction vis-à-vis the nozzle.

11. The spout of claim 1, wherein the nozzle comprises a plurality of barbs and the cap comprises a handle such that the plurality of barbs and the handle cooperate as a ratchet such that the cap can only be rotated in one direction.

12. The spout of claim 1, wherein the cap comprises a bulge thereon from which a shear pin protrudes and wherein the nozzle comprises an opening to cooperate therewith.

13. A plastic spout for a container nozzle of a container for automatically dispensing a separate substance into the container through an opening of the plastic spout, comprising:

a cap;

a capsule that can be filled separately, the filled capsule sealed with a sealing foil or else sealed after filling;

a screw-on nozzle that can be screwed onto the container nozzle in a first direction;

wherein the capsule with its sealing foil can be fixed within the cap or in the screw-on nozzle, and that the screw-on nozzle carries an opening sleeve that stretches inside the container nozzle when the screw-on nozzle is set and includes a piercing and cutting device with a piercing and cutting tooth or a cutting tooth; and a plurality of force transmission components such that the capsule can be displaced downwardly upon turning the cap in a second direction until the cap meets the nozzle at a stop so as to pierce or cut the sealing foil via the piercing and cutting teeth or the cutting tooth; and wherein further turning of the cap in the second direction removes the cap and the nozzle from the container.

* * * * *